US011345537B2

(12) United States Patent
Poehner

(10) Patent No.: US 11,345,537 B2
(45) Date of Patent: May 31, 2022

(54) EXPANDABLE PROTECTIVE ENCLOSURE

(71) Applicant: Marc Poehner, St Louis, MO (US)

(72) Inventor: Marc Poehner, St Louis, MO (US)

( * ) Notice: Subject to any disclaimer, the term of this patent is extended or adjusted under 35 U.S.C. 154(b) by 72 days.

(21) Appl. No.: 16/842,197

(22) Filed: Apr. 7, 2020

(65) Prior Publication Data

US 2020/0299056 A1 Sep. 24, 2020

Related U.S. Application Data

(63) Continuation-in-part of application No. 16/358,984, filed on Mar. 20, 2019, now Pat. No. 10,683,658.

(51) Int. Cl.
*B65D 88/00* (2006.01)
*B65D 88/16* (2006.01)

(52) U.S. Cl.
CPC ..... *B65D 88/005* (2013.01); *B65D 88/16* (2013.01)

(58) Field of Classification Search
CPC ..... B65D 88/005; B65D 88/16; E04H 15/008
See application file for complete search history.

(56) References Cited

U.S. PATENT DOCUMENTS 896,600 A * 8/1908 Thornton ..... B65D 5/12 229/122.27
3,779,448 A * 12/1973 Wootten ..... B65D 13/04 229/198.2
4,077,418 A * 3/1978 Cohen ..... E04H 15/48 135/118
4,984,906 A * 1/1991 Little ..... A45C 9/00 190/107
5,769,106 A * 6/1998 Achuff ..... A41D 15/04 135/95
6,742,533 B2 * 6/2004 Olson ..... E04H 15/30 135/95
6,820,950 B1 * 11/2004 Sun ..... A47B 47/042 312/108
9,777,508 B2 * 10/2017 Kalvani ..... E04H 15/56
10,279,981 B2 * 5/2019 Barias ..... B65D 81/3897
2012/0006701 A1 * 1/2012 Rothschild ..... A45F 4/06 206/216
2019/0256276 A1 * 8/2019 Barlas ..... B65D 37/00
2021/0070540 A1 * 3/2021 Pherson ..... A44B 18/00

* cited by examiner

*Primary Examiner* — Babajide A Demuren
(74) *Attorney, Agent, or Firm* — Gulf Coast Intellectual Property Group

(57) ABSTRACT

An expandable and configurable enclosure that is configured to be envelop at least one object to provide protection thereof wherein said portable enclosure is configured to be assembled into a plurality of alternate shapes and sizes. The portable enclosure of the present invention includes a body wherein the body includes a plurality of panels. The panels of the body are manufactured from a durable flexible material such as but not limited to nylon. The panels include perimeter seams wherein each of the perimeter seams is configured with a fastener. The fasteners are configured to facilitate the operable coupling of a plurality of panels to form a body having an interior volume suitable to accommodate therein a desired object or plurality of objects. The assembled body of the present invention includes at least one end cap member operable to provide access to the interior volume of the body.

7 Claims, 2 Drawing Sheets

EXPANDABLE PROTECTIVE ENCLOSURE

CROSS REFERENCE TO RELATED APPLICATIONS

This non-provisional application is a continuation in part of U.S. patent application Ser. No. 16/358,984 filed, Mar. 20, 2019, entitled, Protective Enclosure with Pressurization Chamber, which is hereby incorporated for reference

FIELD OF THE INVENTION

The present invention relates generally to protective enclosures, more specifically but not by way of limitation, a protective enclosure that is configured to surroundably secure an object or be superposed thereto wherein the protective enclosure is comprised of a plurality of panels releasably secured so as to form a desired shape and size of the protective enclosure.

BACKGROUND

Protective apparatus are well known in the art and range from temporary items such as but not limited to tarps to more elaborate structures such as but not limited to canopies and the like. These enclosures are utilized to provide protection for objects wherein it is desired to inhibit environmental conditions such as but not limited to rain and snow from contacting the objects. Objects such as but not limited to cargo loads of furniture to golf carts are ideally stored such that they are not exposed to rain and other inclimate conditions.

One issue with conventional protection apparatus such as but not limited to tarps are their inability to completely envelop the object desired to be protected. Typical installation of tarps results in superposing thereof over the desired object which leaves the object partially exposed as conventional tarps are provided in defined shapes of squares and rectangles. Alternate enclosures may provide superior coverage to tarps but typically some type of structure or specialized carrier, which are more costly and not adaptable for alternate objects. Existing technology that can provide fully enclosed protection are typically rigid structures that are expensive and further cannot be stored and/or installed in certain areas.

Accordingly, there is a need for a configurable protective enclosure that provides complete enclosure of an object or objects wherein the configurable protective enclosure is comprised of a plurality of releasably secured panels.

SUMMARY OF THE INVENTION

It is the object of the present invention to provide a configurable protective enclosure configured to envelop at least one object and provide protection thereof wherein the configurable protective enclosure includes a body that is manufactured from a flexible material.

Another object of the present invention is to provide an expandable protective enclosure wherein the body thereof is comprised of a plurality of releasably secured panels.

A further object of the present invention is to provide a configurable protective enclosure configured to envelop at least one object and provide protection thereof wherein the plurality of panels of the body form an interior volume ensuing assembly thereof.

Yet a further object of the present invention is to provide an expandable protective enclosure that includes an interior volume wherein the interior volume was formed ensuing assembly of the plurality of panels of the body.

Still another object of the present invention is to provide a configurable protective enclosure configured to envelop at least one object and provide protection thereof wherein the body includes end caps formed from a plurality of panels.

An additional object of the present invention is to provide an expandable protective enclosure that includes an interior volume wherein the plurality of panels have zippers or similar securing elements on each edge thereof.

Yet a further object of the present invention is to provide a configurable protective enclosure configured to envelop at least one object and provide protection thereof wherein an embodiment of the body of the present invention includes a plurality of zippered panels that are configured to facilitate the expansion or contraction thereof.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

and

Figure 3:
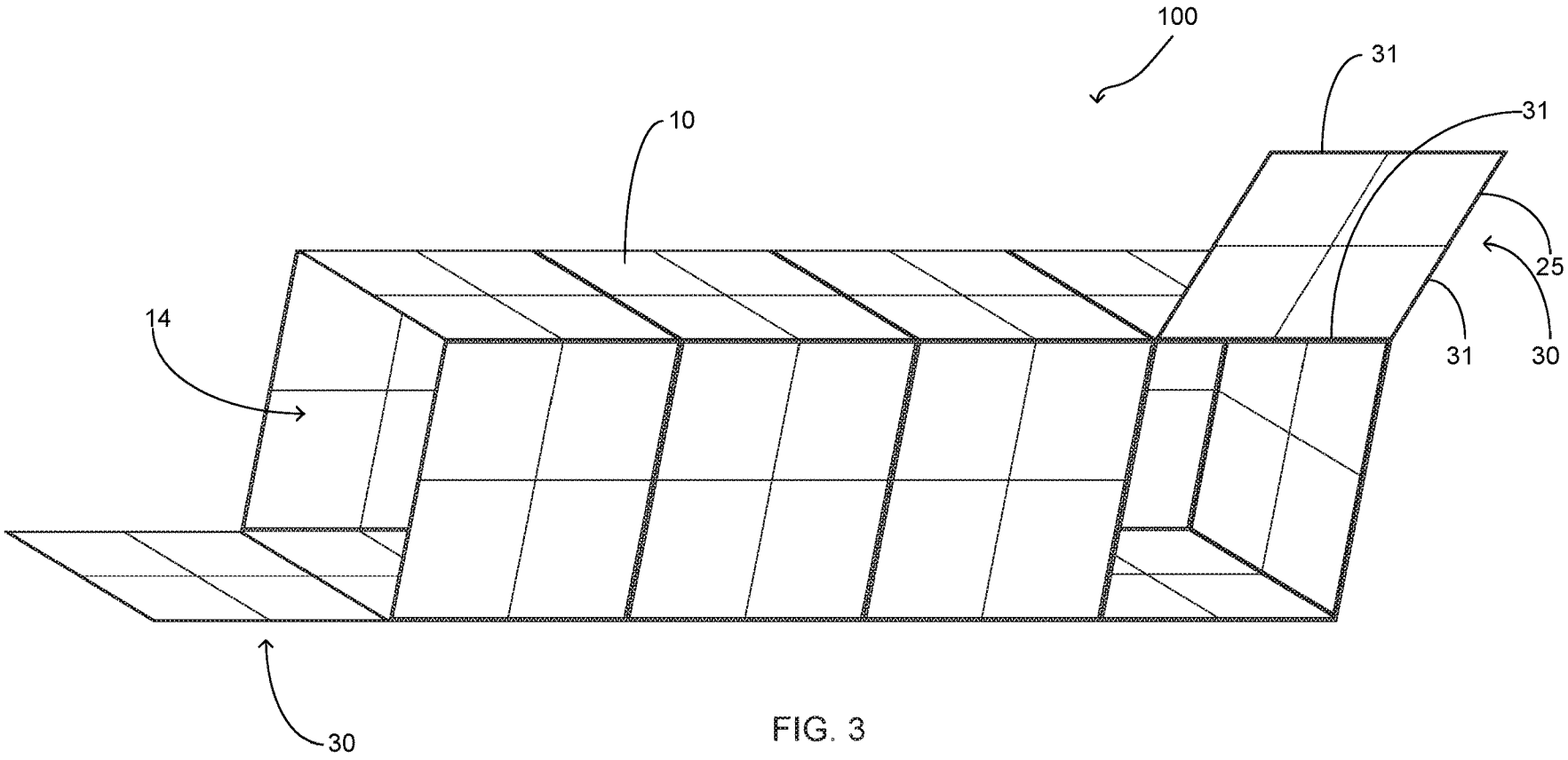

FIG. 3 is a perspective view of an embodiment of an assembled enclosure of the present invention comprised from a plurality of panels thereof.

DETAILED DESCRIPTION

Referring now to the drawings submitted herewith, wherein various elements depicted therein are not necessarily drawn to scale and wherein through the views and figures like elements are referenced with identical reference numerals, there is illustrated configurable protective enclosure 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith the configurable protective enclosure 100 includes a body 10 wherein the body 10 includes a plurality of panels 20 that are releasably secured to create an interior volume 14. The body 10 and the panels 20 thereof are manufactured from a durable flexible material such as but not limited to nylon. As will be further discussed herein, the body 10 is configured to be expandable and provided in various sizes and shapes so as to provide enclosure of alternate objects.

Figure 1:
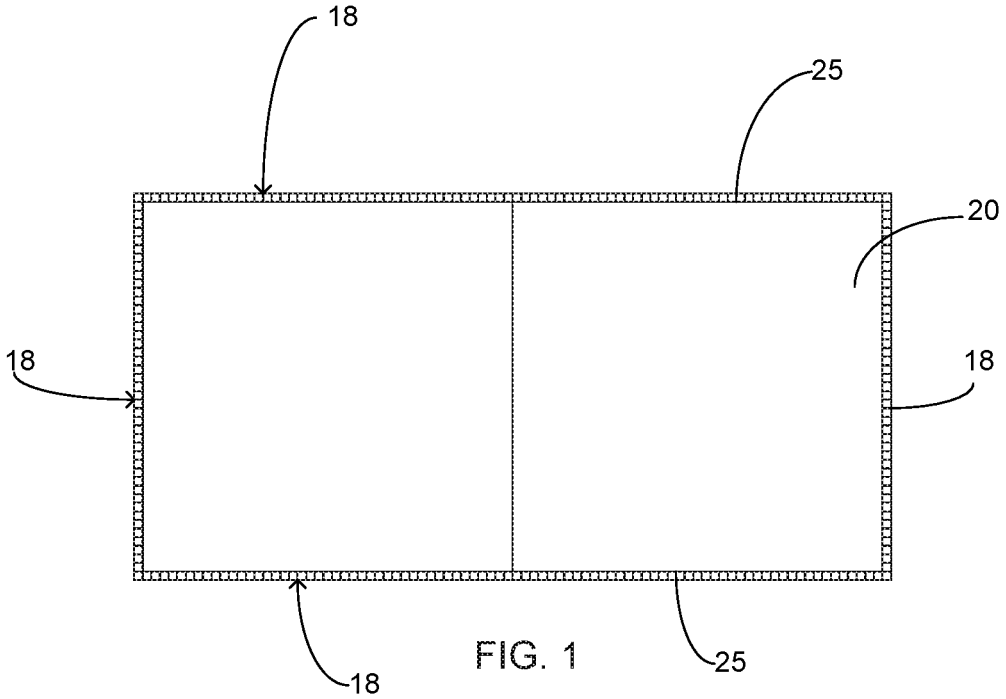
FIG. 1 is a top view of an embodiment a panel of the present invention.
Figure 2:
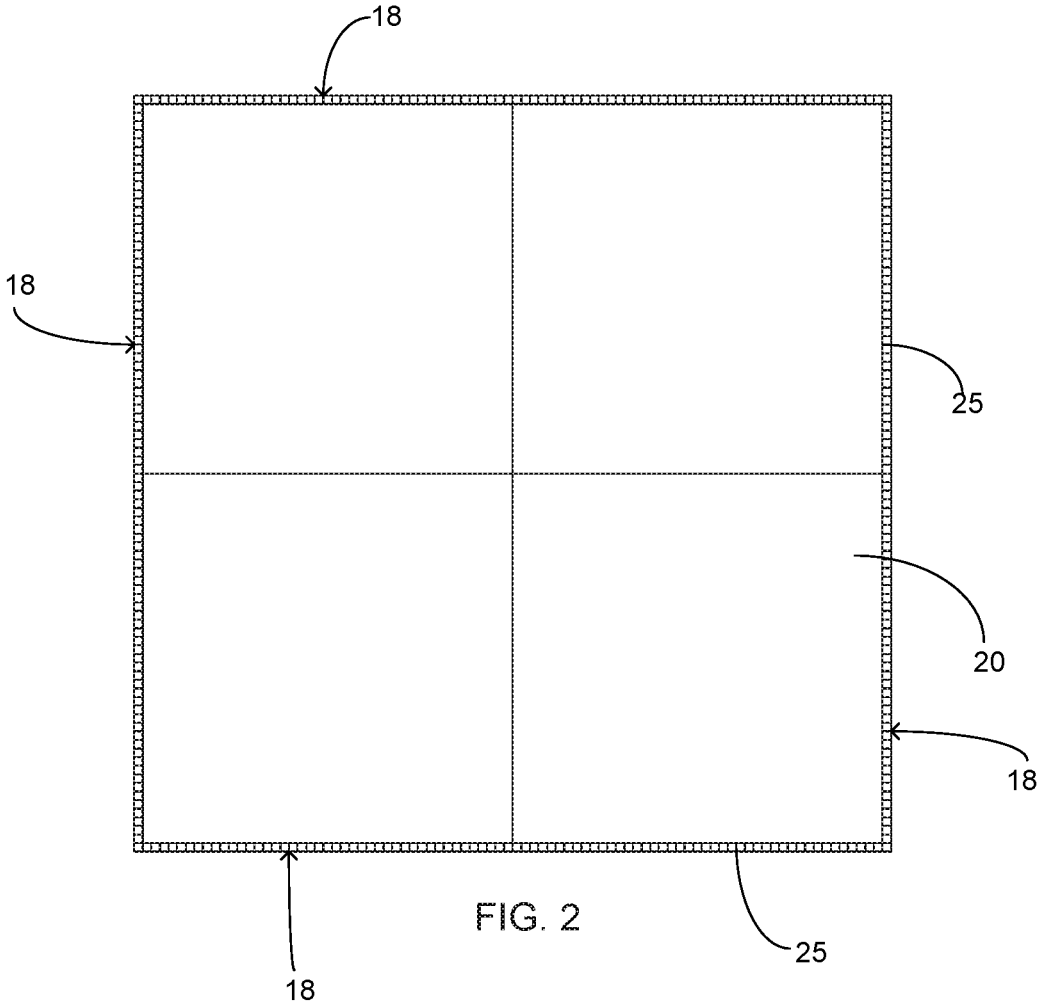
FIG. 2 is a top view of an exemplary panel of the present invention.

The panels 20 of the body 10 are illustrated herein in FIG. 1 and FIG. 2. The exemplary panels 20 are provided in two possible shapes but it should be understood within the scope of the present invention that the panels 20 of the configurable protective enclosure 100 could be provided in numerous alternate sizes and shapes. The panels 20 include perimeter seams 18 wherein the perimeter seams 18 are configured to provide the expansion and/or alteration of the size of the body 10. The perimeter seams 18 have integrated thereon a fastener 25. In a preferred embodiment the fastener 25 is a zipper or other similar type fastener that facilitates the separation and coupling of the panels 20.

The body 10 have operably coupled therewith end cap members 30 that provide closure of the configurable protective enclosure 100. The end cap members 30 are manufactured of a similar material as that of the panels 20 and are planar in manner. The end cap members 30 include perimeter edge 31 that include fasteners 25 that facilitate the releasably securing of the end cap members 30 to the body 10 forming a complete enclosure defining an interior volume 14 operable to receive and store objects therein. It should be understood within the scope of the present invention that the fasteners 25 on the perimeter edge 31 could be formed from zippers, tongue and groove or other mateable type fasteners configured to provide releasable securing. It is contemplated within the scope of the present invention that the end cap members 30 could be provided in alternate shapes in addition to the shapes illustrated herein. Furthermore it should be understood that the end cap members 30 could be provided in alternate sizes. The end cap members 30 form openings 35 that provide access to the interior volume 14 of the body 10. While not particularly illustrated herein, in a preferred embodiment of the configurable protective enclosure 100, the fasteners 25 are configured to be operated from a midpoint along the length thereof. It should be further understood within the scope of the present invention the body 10 could be configured with only one end cap member 30 or a plurality thereof wherein the quantity of end cap members 30 is dependent on the assembled shape of the body 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A configurable portable enclosure having an interior volume operable to receive therein at least one object:

a body, said body having an interior volume, said body being comprised of a panel, said panel of said body being manufactured from a flexible material, said panel having a perimeter seam, said panel having a midpoint, said panel having a lateral edge and a second lateral edge, said panel having a first end edge and a second end edge, said perimeter seam having a first fastener on said first lateral edge, said perimeter seam having a second fastener along said second lateral edge, said first fastener being a male zipper, said second fastener being a female zipper, said first fastener and said second fastener extending from said midpoint to said first end edge; and wherein the body of configurable portable enclosure includes at least one end cap member operable to provide access to the interior volume of the body.

2. The configurable portable enclosure as recited in claim 1, wherein said panel further includes a third fastener and a fourth fastener, said third fastener extending along said first lateral edge from said midpoint to said second end edge.

3. The configurable portable enclosure as recited in claim 2, wherein said fourth fastener extends along said second lateral edge from said midpoint to said second end edge.

4. The configurable portable enclosure as recited in claim 3, wherein the body is configurable into a plurality of alternate shapes and sizes.

5. An expandable portable enclosure having an interior volume operable to receive therein at least one object that is configured to be assembled into a plurality of alternate sizes wherein the expandable portable enclosure comprises:

a body, said body having an interior volume, said body being comprised of a plurality of panels, said plurality of panels of said body being manufactured from a flexible material, said plurality of panels being square in shape, said plurality of panels having an inner surface and an outer surface, wherein each of said plurality of panels have a midpoint, said plurality of panels having perimeter seams, said perimeter seams having a first end and a second end, said plurality of panels having a first fastener, said first fastener being secured proximate a first lateral edge, said first fastener operable to move from said midpoint to a first end along said first lateral edge, said first fastener being a male fastener, said plurality of panels having a second fastener, said second fastener being proximate a second lateral edge, said second fastener configured to move from said midpoint to an endpoint of said second lateral edge, said second fastener being a female fastener and capable of coupling with said first fastener, said plurality of panels having a third fastener, said third fastener being secured to each of said plurality of panels proximate a first end thereof, said third fastener configured to move from an initial position proximate a longitudinal midpoint on each of said plurality of panels to and endpoint of said first end of said plurality of panels, said third fastener being a male fastener, said plurality of panels having a fourth fastener, said fourth fastener being secured to each of said plurality of panels proximate a second end thereof, said fourth fastener configured to move from an initial position proximate the longitudinal midpoint on each of said plurality of panels to and endpoint of said second end of said plurality of panels, said fourth fastener being a female fastener configured to couple to said third fastener; and wherein the plurality of panels having the first fastener, second fastener and third fastener and fourth fastener are operable to completely envelop an object.

6. The expandable portable enclosure as recited in claim 5, wherein said first fastener, said second fastener, said third fastener and said fourth fastener are zippers.

7. The expandable portable enclosure as recited in claim 6, wherein the body is configurable into a plurality of alternate shapes and sizes.

* * * * *